United States Patent [19]

Kunz et al.

[11] 3,943,689

[45] Mar. 16, 1976

[54] METHOD OF AND APPARATUS FOR TWISTING YARN OR THREAD

[75] Inventors: Albert Kunz; Helmut Kullmann, both of Arbon, Switzerland

[73] Assignee: HAMEL Projektierungs- und Verwaltungs-AG., Horn, Thurgau, Switzerland

[22] Filed: Oct. 10, 1972

[21] Appl. No.: 296,176

[30] Foreign Application Priority Data

Oct. 7, 1971 Germany ..... 2150148
Sept. 14, 1972 Germany ..... 2245205

[52] U.S. Cl. ..... 57/34 R; 57/61; 57/82; 57/156; 324/171

[51] Int. Cl.² ..... D01H 1/30

[58] Field of Search ..... 57/34 R, 34 PW, 61, 78, 57/82, 156; 324/171

[56] References Cited

UNITED STATES PATENTS

| | | | |
|---|---|---|---|
| 2,944,382 | 7/1960 | Batty et al. | 57/62 |
| 3,345,812 | 10/1967 | Pickering | 57/61 X |
| 3,478,504 | 11/1969 | Nimtz et al. | 57/156 X |
| 3,496,343 | 2/1970 | Johanson | 324/171 |
| 3,538,699 | 11/1970 | Cunningham | 57/78 X |
| 3,548,165 | 12/1970 | Linnenkamp | 324/171 |
| 3,613,347 | 10/1971 | Carruthers | 57/34 R X |
| 3,665,306 | 5/1972 | Orth | 57/34 R UX |
| 3,727,033 | 4/1973 | Bassist | 324/171 UX |

*Primary Examiner*—Richard C. Queisser
*Assistant Examiner*—Charles Gorenstein
*Attorney, Agent, or Firm*—Karl F. Ross; Herbert Dubno

[57] ABSTRACT

A system for the spinning or twisting of thread or yarn in which a thread is supplied by a strand-supply spool and is collected on a strand-takeup spool so that the strand spans the distance between the spools over a predetermined length, the twist-generating spool being driven for a predetermined number of turns to bring the number of twists over the length to the normal twisting level before the two spools are operatively connected together for joint operation at the normal rate. The delay between operation of the nontwist-generating spool and the twist-generating spool is created by a counter responsive to the number of twists produced in the length during the interval.

18 Claims, 5 Drawing Figures

METHOD OF AND APPARATUS FOR TWISTING YARN OR THREAD

FIELD OF THE INVENTION

The present invention relates to a spinning, twisting or twining apparatus and method for imparting a twist to a thread, filament, yarn, roving or other strand between a strand-supply spool and a strand-takeup spool. More particularly, the invention deals with a system for the twisting of such strands in which, in earlier arrangements, insufficiently twisted portions or lengths could arise.

BACKGROUND OF THE INVENTION

In the production of thread or yarn, it has become the common practice to spin, twist or twine a strand consisting of one or more filaments or fibers more or less tightly in transferring it from a cop or bobbin to a yarn package or, more generally, from a strand-supply spool to a strand-takeup spool. One of the spool spindles is generally rotated about an axis to impart the desired twist to the strand while the other spool may merely be rotatable to take up or pay off the strand to be twisted.

When reference is made herein to a "strand," therefore, we intend to designate thusly any thread, yarn or other twistable and elongated member, consisting of one or more filaments or fibers and composed of natural or synthetic materials, which may be commonly subjected to twisting, twining a spinning in the aforedescribed manner. Further, we shall heretofore use the term "twisting" to describe the step of imparting a twist to a length of thread between a pair of spools, e.g. by rotating one of the spools and/or a thread guide or the like as is commonly known in the art. This term will therefore include the classical definition of spinning and twining. The twisting is usually accomplished between a pair of spaced apart contact locations, one on the twisting mechanism and the other at the nontwist-imparting spool. Also, reference to the spool "rotation" is intended to include rotation of the spindle, traveler-ring devices, etc. used to provide the contact location, whether or not the yarn body is actually rotated.

In most twisting devices, the strand-takeup spool and the strand-supply spool are mechanically connected together for joint operation so that he strand is wound upon the takeup spool at a given rate with respect to the twisting rate so that the strand is advanced at a definite feed rate (strand-feed rate) in units of length per unit time (e.g. meters per minute) while the twist-imparting spool is driven at another predetermined rate (twisting rate) generally given in terms of revolutions per minute or twists per minute. The number of twists per unit length (twists per meter) is then given as the quotient of the twisting rate and the strand-feed rate.

The ratio of the transmission means which operatively and positively connects the supply spool with the takeup spool thus is able to determine the number of twists imparted to the thread per unit length.

When a new thread length is to be added to the yarn package or for some other reason, a fresh length of the strand is to be knotted to a previously twisted length of strand in the space between the two spools, there remains an untwisted section as the two spools are again operated at their predetermined ratio of speeds. The knotted, formerly free end, of the previously twisted portion of the strand (e.g. on the yarn package or takeup spool) and the portion of the strand newly tied thereto, both are free from the twists which are normally imparted to the strand and hence the strand is not uniform. Spool processing may be carried out to impart an appropriate twist to this length and/or, the untwisting length may be ignored or removed after the yarn is otherwise finished. Poor quality thread is obtained or the processing costs are prohibitively increased.

OBJECTS OF THE INVENTION

It is the principal object of the present invention to provide an improved yarn-twisting apparatus wherein the aforedescribed disadvantages will be avoided.

It is another object of the invention to provide a method of operating a twisting apparatus and/or a method of twisting a strand with increasing uniformity and without any of the earlier difficulties with respect to under-twisted lengths of the strands.

Still another object is to provide a method of and an apparatus for the improved twisting of strands to increase the uniformity over the entire length of the strand wound up upon the strand-takeup spool.

SUMMARY OF THE INVENTION

We have found that these disadvantages can be eliminated in a system for the twisting of yarn or thread strands in which an untwisting strand, provided between a strand-supply spool and a strand-takeup spool is formed, e.g. when a new length of thread or yarn is tied to the end of a previously twisted length of thread or yarn, the twist-imparting mechanism only being driven to twist the length of thread spanning the two spools for a predetermined twist count, whereupon the spools are coupled for joint operation to advance the strand during twisting.

In other words the present invention provides for the operation of the twist-imparting spool without advance of the strand for a twist count sufficient to compensate for the lack of twisting over the aforementioned length of thread spanning the two spools before the thread is again advanced by synchronously coupling and driving the two spools so that the thread pays out of the supply spool and is wound up twisted upon the takeup spool. The system, according to the present invention, thus includes a twist counter responsive to the number of twists applied to the aforementioned length of strand for operatively connecting the two spools for joint rotation when a predetermined thread count is attained. For example, when the normal twist rate is X twists per meter and the length of the gap between the spools is L (meters), the twist count prior to coupling of the two spools must be $T = L \times X$.

We are aware that it has been proposed to provide a clutch in so-called ring-spinning machines which delayed the drive of the leading rollers to permit the twisting of a length of yarn behind them. However, this system, which had no twist counter, was not able to provide an accurate twist to the length of untwisted yarn and was found to be particularly undesirable when two or more threads were to be twined together. The result was an undesirable twisting of the portions of the strand which were untwisted in the prior arrangements. The counter of the present invention ensures complete accuracy.

According to the present invention, moreover, the invention comprises a nontwist-imparting spool which is triggerable by a delay means at a time removed from the actuation of the twist-imparting spool under the control of a counter responsive to the number of twists applied to the length of the strand between the spools. The nontwist-imparting spool is then driven only when the twist-imparting spool has been operated through the precise number of turns required to bring the twist rate over the aforementioned length up to the desired, normal value. Twist faults are thus entirely avoided.

According to the method aspects of the invention, we provide a method of twisting thread wherein a strand is fed by a strand-supply spool to a strand-takeup spool and a length of the strand spans the spools, one of which is a twist-imparting member while the other is a nontwist-imparting member. According to the invention, a new length of the thread may be tied to the preceding length of thread between the spools, the twist-imparting spool is rotated while the nontwist-imparting spool is held stationary for a number of turns of the twist-imparting spool, corresponding to the number of twists over the length of the strand bridging the spools corresponding to the normal twist rate, whereupon the nontwist-imparting spool is actuated to advance the strand from the supply spool to the takeup spool and the two spools are driven synchronously to maintain the normal twisting characteristic.

The invention also includes a method of operating a thread or yarn spinning or twisting apparatus provided with a thread-supply spool, a thread-takeup spool, means for driving one of these spools to constitute thereof a twist-imparting mechanism, and means coupling the spools for joint operation to produce a normal twist number per unit length in the yarn, thread or strand transferred from the supply spool to the takeup spool. In terms of the method of operation, therefore, we temporarily immobilize the strand-takeup spool and the strand-supply spool to enable, for example, a fresh length of the strand to be attached to the takeup spool, actuate the twist-imparting mechanism for a number of turns corresponding, over the length of yarn between the spools, to the normal twist rate and only then, upon the twist count having reached the appropriate number, operating the takeup spool to permit the strand to advance for normal twisting.

The delay device for causing a functional lag between the supply spool and the takeup spool can comprise a switchable clutch between the nontwist-imparting spool and its drive means. The clutch may be triggered from a switching system responsive to a counter while a feedback path is provided between the clutch-switch means and the counter to reset the counter upon closure of the clutch. This prepares the counter for the next interruption of the twisting operation. The clutch actuating and/or the resetting of the counter manually is thereby rendered unnecessary.

Advantageously, the twist-imparting spool is provided with a pulse generator for producing a pulse at each rotation of the twist-producing spindle, the counter responding to the pulses. According to this aspect of the invention, the rotating member of the twist-imparting spool may be provided with an orbiting permanent magnet while an electromagnetic sensor is provided adjacent the orbital path. At each sweep of the permanent magnet past the stationary sensor, therefore, a pulse is produced in the latter which may be recorded in the counter. The counter may be an electronic register and/or a mechanical register on which the instantaneous count is displayed. With high-twisting speeds and high rotational speeds of the twist-imparting member, it has been found to be desirable to avoid an instantaneous or impact-like engagement of the clutch. In this case, we provide means for reducing the relative rotation speeds of the twist-imparting and nontwist-imparting spools, e.g. by slowing the twist-imparting spool prior to clutching or even bringing it to a standstill. The two spools can then be driven and accelerated simultaneously to their desired normal speeds while being synchronized with one another to maintain the normal twist rate (number of twist per unit length) in spite of the variation of speed. The term "synchronized" is used herein to indicate that the two spools are coupled together such that the strand speed and the rotational speed of the twist-imparting spool are maintained in a fixed ratio in spite of variations in the thread speed.

To avoid a sudden change in the speed of the twist-imparting spool, after the desired number of twists are attained, we may employ the twist count to control the speed of the twist-imparting spool so as, for example, to increase this speed initially from zero and then decrease the speed to zero at the time the desired number of twists is attained and both spools are to be driven synchronously.

We are also able to avoid the sudden engagement of the clutch at high speeds of the twist-imparting spool when the latter is brought, during the twisting of the stationary length of thread between the spools, to a rotational speed such that the nontwisted-imparted spool can be accelerated to its corresponding speed rapidly, thereby preventing any sudden shock at the clutch. Both spools can then be accelerated together to the elevated normal operating speed with the spools being synchronously coupled as described above. A brake arrangement can be provided for the twist-imparting spool when the latter is to be brought to standstill, the brake being controlled at least in part in accordance with the twist count. Where the speed of the twist-imparting spool is simple to be regulated to prevent an excess speed at the moment of synchronous coupling of the spools, we may provide a speed governor or like rotational-speed control means of conventional construction, likewise operated by the counter, to reduce, regulate or terminate rotation of the twist-imparting spool.

Preferably the drive means for the twist-imparting spool is provided with a speed controller which regulates the velocity of the twist-imparting spool until the desired twist count is reached and which thereupon operates a clutch connecting the two spools or synchronous rotation. The speed controller can then accelerate both spools to the normal twisting speeds.

The invention is applicable to both traveler-ring spinner and twister devices as well as to twisting or spinning devices from which the strand is drawn upwardly.

DESCRIPTION OF THE DRAWING

The above and other objects, features and advantages of the present invention will become more radily apparent from the following description, reference being made to the accompanying drawing in which.

SPECIFIC DESCRIPTION

In the description below the term "speed" or "rotational speed" is used to refer to the number of rotations of a spool per unit time, e.g. revolutions per minute (RPM) while the term "number of rotations" is used to describe the actual number of rotations made by the twist-imparting spool and is independent of time. The "twist count" will generally refer to the number of rotations of the twist-imparting spool as defined above and is independent of time, being the number of twists imparted to the length of the strand between the two spools. Furthermore, the term "spool" is used herein to refer to any spinning or twisting bobbin, cop or yarn package and will describe the mass of the yarn or thread carried by the twist-imparting means or the yarn-takeup means, the spools being either of the travelers ring or some other conventional spinning or twisting type. The "twist rate" is the number of twists per unit length and may be given in terms of twist number per meter of the yarn.

Figure 1:
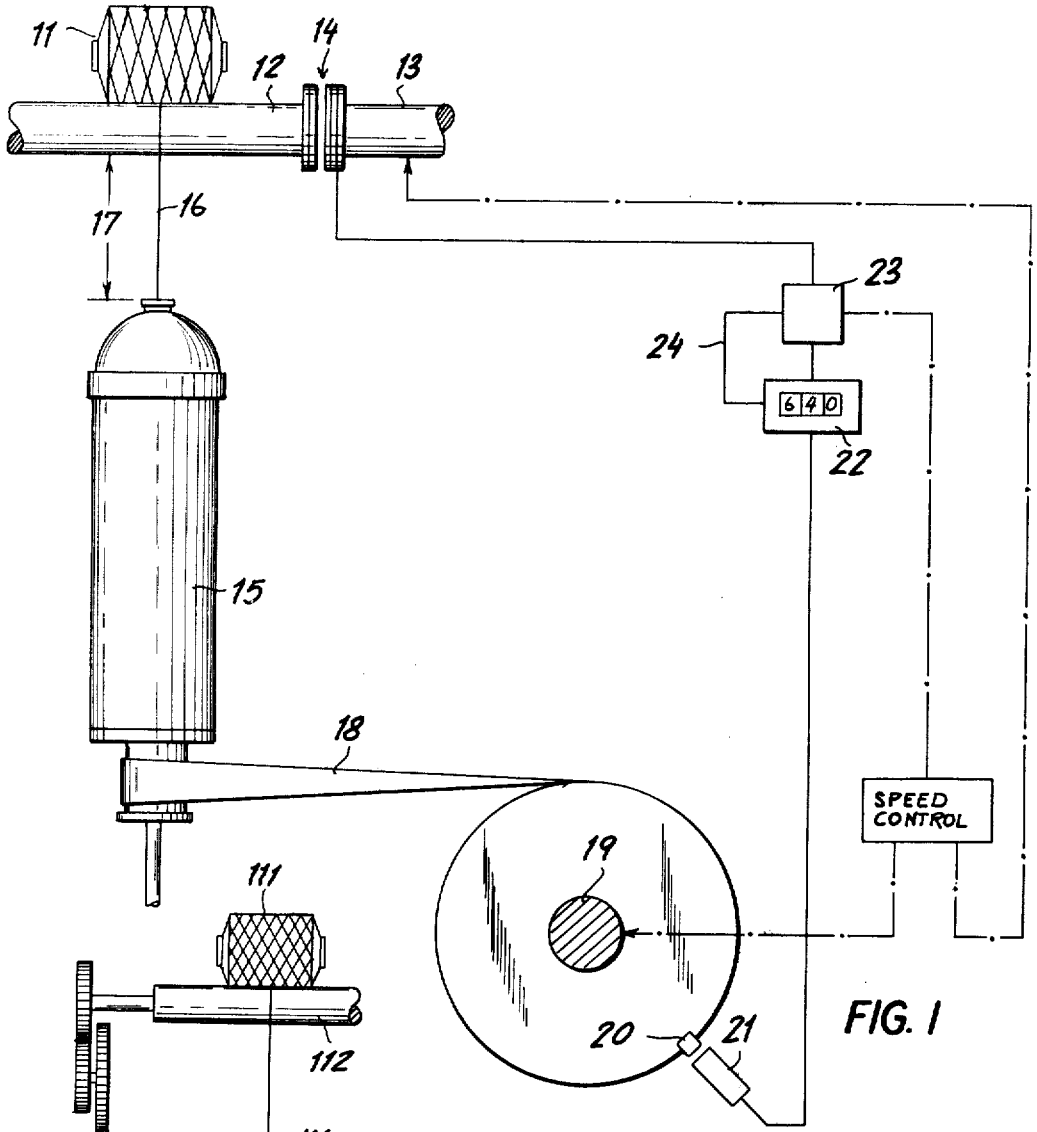
FIG. 1 is a diagrammatic elevational view of a yarn-spinning or twisting apparatus embodying the present invention.

In FIG. 1, we show a twist-imparting spindle 15 of the bell-spindle type which is driven to impart a twist to the strand 16 emerging from the top thereof by a belt 18 passing around the whorl of the spindle. The twisting device may be thus of the type described in the commonly assigned copending applications Ser. Nos. 264,280 now U.S. Pat. No. 3,783,597, issued Jan. 8, 1974 and 188,335 now U.S. Pat. No. 3,742,693 filed June 19, 1972 and Oct. 12, 1971 respectively. The strand 16 to be twisted extends along a twisting path 17 between the strand-supply spool 15 and a strand-takeup spool 11 which rotates upon a driven cylinder or drum 12 and clamps the thread 16 at the point at which the latter passes between the body of the yarn package 11 and the surface of cylinder 12. The latter is connectable by a clutch 14 with a drive shaft 13 of the drive means.

Figure 4:
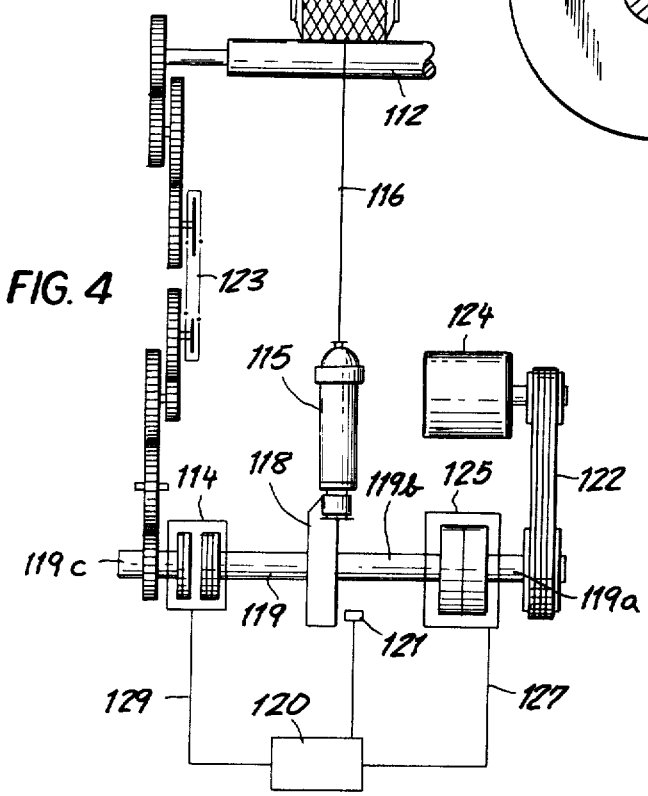
FIG. 4 is a schematic diagram illustrating the means for synchronously connecting the two spools according to the invention.

The belt 18 rotates the spindle 15 as described above and is driven by a spindle drive shaft 19 which is synchronously connected with the drive shaft 13, e.g. by the means illustrated in FIG. 4. The belt arrangement is so constructed and arranged so that there is no significant slip between shaft 19 and the spindle 15, i.e., so that for each revolution of the shaft 19, the spindle 15 makes a given number of revolutions or turns and imparts a corresponding number of twists to the thread 16. Since the shafts 19 and 13 are coupled together, this shaft is rotated through a predetermined angle for each revolution of shaft 19 and, when clutch 14 is closed, rotates the yarn package 11 to take up a fixed length of thread for each revolution of shaft 19 and hence for each predetermined number of turns of the spindle 15 or twist of the yarn 16.

The sheave of shaft 19 and belt 18 is provided with a permanent magnet 20 juxtaposed with a magnetic-field sensor located at a fixed location along the orbit of the permanent magnet. Members 20 and 21 thus constitute a pulse generator which, for each rotation of the spindle drive shaft, generates a pulse which is applied to a pulse counter 22 calibrated directly in number of twists as described above. The pulse counter 22 is connected to a threshold device or comparator 23 which compares the count of counter 22 with a predetermined count and energizes the clutch 14 when the predetermined count is reached. This predetermined count can, of course, be set as well.

A feedback path 24, responsive to the engagement of clutch 14, connects the comparator 23 with the counter 22 to reset the latter. The resetting can of course be done by hand if desired.

Under normal operating conditions, clutch 14 is closed and the spindle 15 and the yarn package 11 are driven synchronously to impart X number of twists per meter to the yarn.

When it is desired to insert a new cop at spool 15 or to knot the thread 16, the machine is stopped, the clutch 14 opened and the new thread length attached. The machine is then started to drive the spindle 15 until the count registered at 22 reached the value T where $T = L \times X$, L being the length in meters of the stretch 17. At this instant, the clutch 14 is triggered so that takeup spool 11 operates to accept the twisted yarn and synchronous operation of the spool is effected. The switch 23 may be operatively connected to the drive for shaft 19 as illustrated in FIG. 1 to bring the latter to standstill before clutch 14 is operated and then accelerate both spools simultaneously.

Figure 2:
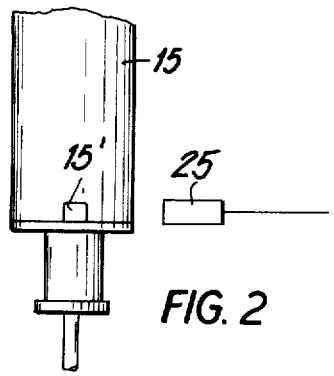
FIG. 2 is a detail view of a portion of the apparatus of FIG. 1, drawn to a larger scale.

In FIG. 2, we show an arrangement in which the electromagnetic sensor 25 is juxtaposed with a permanent magnet 15' directly upon the spindle, whereupon each pulse represents one unit of the counter 22.

Figure 3:
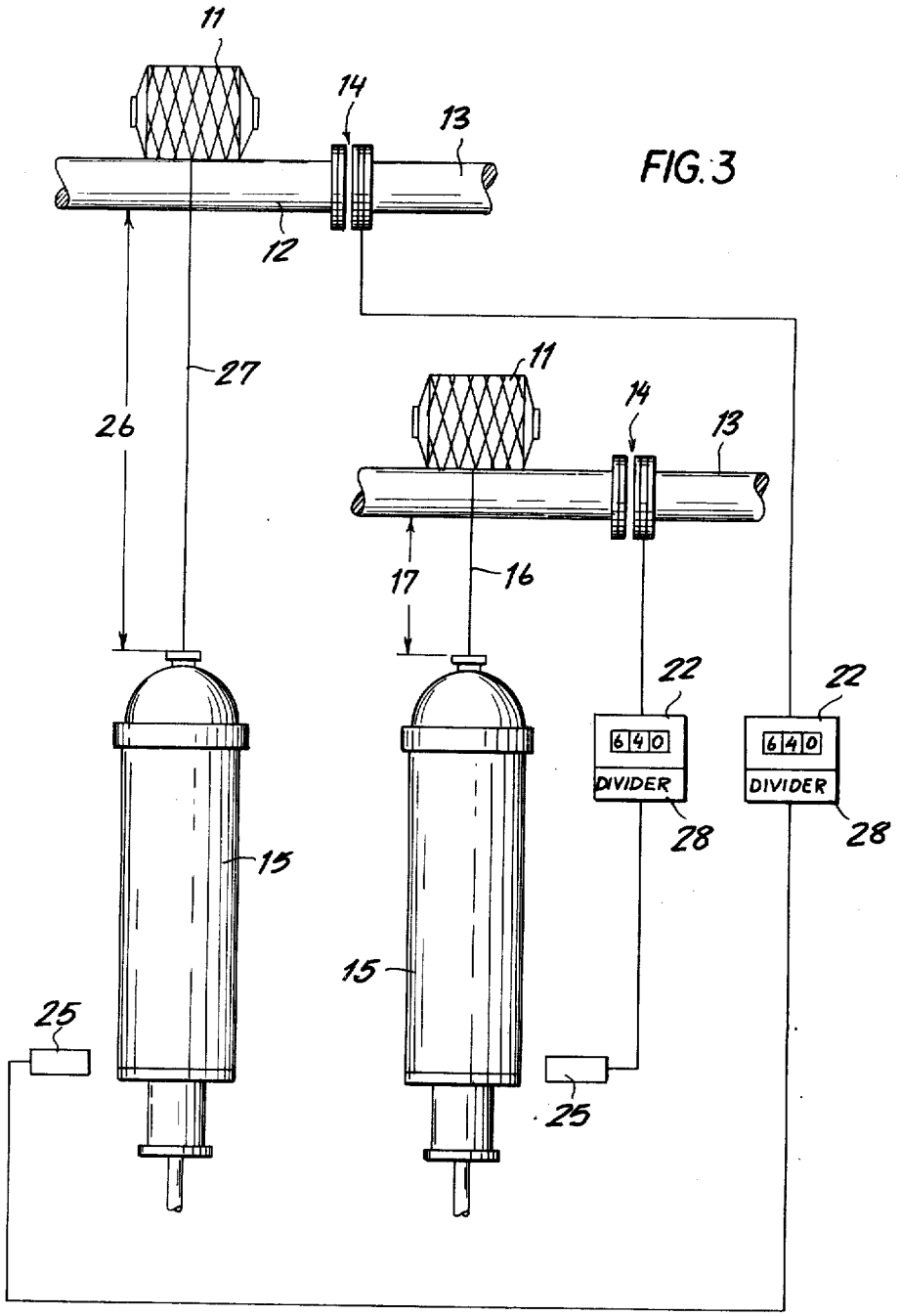
FIG. 3 is a view similar to FIG. 1 of an apparatus in which the length of yarn between the spools may differ for the several stations.

In FIG. 3, we show a system in which a bank of spindles 15 as described in connection with FIG. 2, is provided, in individual lengths of the strand between the spools and the respective yarn packages differing. Hence one spool 15 may be located closer to its package 11 so that the stretch 17 of yarn between the clamping point and the spindle 15 may be shorter than the stretch 26 spanned by the yarn 27 between the other spindle 15 and its package 11. In this case, each counter 22 is provided with a threshold device 28, calculator or electronic quotient former (divider) which triggers the respective clutch 14 when the associated count has reached the desired number so that the ratios T/L for the systems will be identical. Since the total number of counts prior to clutch engagement for each of the stretches is a function of the length of the gap 16 or 26, the counters must be set to respond to respective counts and are independent of one another. Furthermore, the system of FIGS. 1 – 3 is merely illustative and the invention is equally applicable to an arrangement in which the yarn is drawn downwardly from the spindle.

In FIG. 4 we have shown a bell-type spindle 115 carrying a twist-imparting spool **115*a* spaced from a nontwist-imparting spool or yarn package 111 so that the yarn extends in a stretch 16 between them. The twist-imparting spool 115*a* is driven by a motor 124 via a belt drive 122 and a shaft with the drive portion 119*b* thereof. The motor 124 and belt drive 122 are coupled to shaft portion 19*a* while the spindle 115 is connected by a belt arrangement 118 with the shaft portion 119*b*. The shaft 119 is also provided with a permanent magnet which is juxtaposed with an electromagnetic sensor 121** to provide a pulse train representing the twist count.

A clutch 114 is provided between the shaft portion **119*b* and a shaft portion 119*c* connected by a gear, chain or belt arrangement 123 for the shaft 112 rotating the yarn package 111. When the clutch 114** and 115 are closed, the spindle 115 and the yarn package 111 are rotated at a fixed ratio which can be adjusted by altering the transmission ratio of the transmission 123. The counter 120 responds to the pulse train detected at 121 and is connected by a line 127 to clutch 125 and by a line 129 to a clutch 114 so that, when the desired count is reached, as described above, clutch 125 is opened to bring the spindle 115 to standstill or another speed below the prior twisting speed, clutch 114 is closed and clutch 125 is reclosed to couple the two spools together and drive them synchronously. The counter may, alternatively, include a rate meter which maintains the speed of the drive system as described above and operates the clutch 114 without bringing the system to standstill. The clutch 125 may be of a controlled type for operating the system at a high speed in response to the count or after a predetermined interval of operation at a lower rate of speed. The drive 119 etc. may thus operate at a low speed during counting and may be shifted into a higher speed condition when the desired twist count is reached.

When the clutch 14, 114 is of the controlled-speed type, it may be used to accelerate the posttwist-imparting spool to the speed corresponding to that of the twist-imparting spool prior to the synchronous interconnection of the spools.

Figure 5:
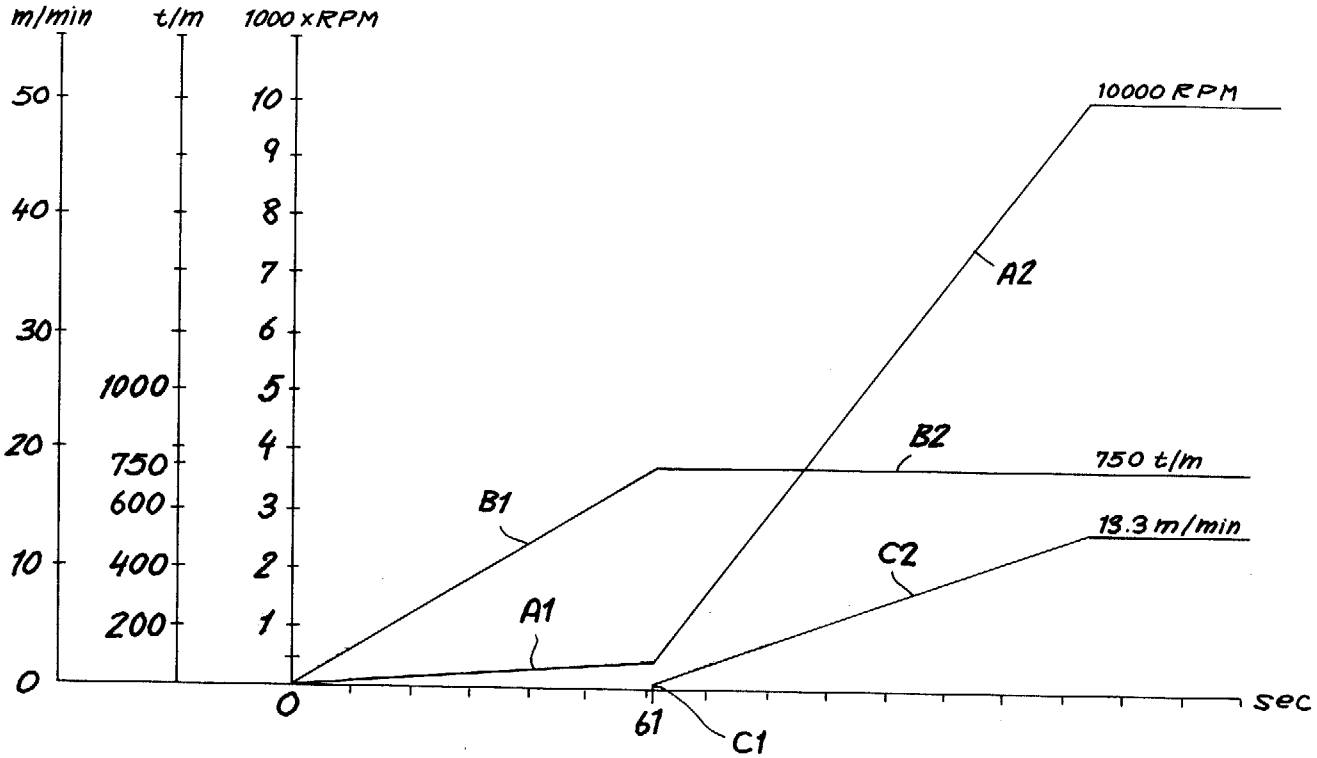
FIG. 5 is a timing diagram illustrating the process of the invention.

One example of the application of the present invention can be seen in FIG. 5 in which time is plotted along the abscissa and the spindle speed in revolutions per minute is plotted along ordinate I, the number of twists per meter is plotted along ordinate II and the strand speed in meters per minute is plotted along ordinate III.

In the interval between $t = 0$ and $t = 61$ seconds, the thread is not advanced although the spindle is driven and the desired number of twists are imparted to the length 116 of the strand between the yarn packages. The number of twists developed during the portion of the curve represented at $B_1$ thus represents the number corresponding to that which will yield the normal twist rate of 750 twists per minute. Since the two spools are then connected synchronously, the twist-rate characteristic in twists per minute is held constant at 750 turns per meter along the horizontal stretch $B_2$ of the curve. Along the stretch $A_1$, corresponding to low-rotational speed of the spincle, the initial group of turns is formed whereupon the spindle is accelerated (curve $A_2$) with synchronous acceleration of the yarn package. The yarn, which is essentially stationary during the initial twist period, is accelerated commencing at $C_1$, at a rate represented at $C_2$. When the two spools have been brought up to a normal winding speed, all three curves are at a plateau.

We claim:

1. In a method of operating a strand-twisting installation wherein a strand passes from a strand-supply spool to a strand-takeup spool and at one of the spools forms a twist-imparting mechanism, the improvement which comprises the steps of:

a. operating said twist-imparting mechanism to twist the strand between said spools prior to advancing the strand until the length of the strand between said spools has received a predetermined number of twists;

b. advancing said strand between said spools;

c. synchronously driving said spools with said strand advancing between them while operating said mechanism to twist the advancing strand only upon the generation of said predetermined number of twists in said strand:

d. counting the number of turns of said mechanism and registering the counted number of turns prior to advance of the strand the number of turns imparted to said strand between said spools, said spools being coupled for synchronous operation only upon the registered count attaining a predetermined value; and reducing the speed of said mechanism in response to the registered count prior to coupling said spools for synchronous operation.

2. The improvement defined in claim 1 wherein said mechanism is brought to standstill for coupling of said spools for synchronous rotation.

3. The improvement defined in claim 1, further comprising the step of jointly accelerating said spools subsequent to the coupling thereof for synchronous operation.

4. The improvement defined in claim 1 wherein said mechanism is initially accelerated from standstill and is decelerated thereafter in response to the registered count prior to coupling of said spools for synchronous rotation.

5. The improvement defined in claim 1 wherein said mechanism includes said supply pool and said takeup spool is accelerated to a speed enabling coupling of said spools for synchronous operation, said spools being thereafter accelerated to an elevated speed for normal operation.

6. A strand-twisting apparatus comprising a strand-supply spool and a strand-takeup spool, one of said spools forming a twist-generating mechanism; means for driving said twist-generating mechanism; a counter responsive to the number of twists produced by said twist-generating mechanism; and means connected to said counter and synchronously connecting said spools for joint operation to advance said strand between them only upon the attainment of a predetermined count.

7. The apparatus defined in claim 6 wherein said means synchronously connecting said spools for joint operation includes a clutch actuated by said counter.

8. The apparatus defined in claim 7, further comprising a control circuit connected to said counter for electricaly energizing said clutch.

9. The apparatus defined in claim 8, further comprising feedback means connecting said circuit with said counter for resetting the latter to zero upon closure of said clutch.

10. The apparatus defined in claim 9 wherein said counter is provided with calculating means responsive to the length of the strand between said spools for triggering said clutch upon the attainment of a predetermined count determined by said length.

11. The apparatus defined in claim 7 wherein said mechanism is provided with a pulse generator producing a train of pulses representing twists of said strand, said pulse generator being connected to said counter.

12. The apparatus defined in claim 11 wherein said pulse generator includes an orbital permanent magnet and a stationary electromagnetic sensor responsive to the field of said permanent magnet.

13. The apparatus defined in claim 11 wherein said pulse generator is connected directly to said supply spool and said supply spool forms said mechanism.

14. The apparatus defined in claim 11 wherein said pulse generator is provided on said means for driving said mechanism.

15. The apparatus defined in claim 7, further comprising means responsive to said counter for reducing the speed of said mechanism prior to operation of said clutch.

16. The apparatus defined in claim 15 wherein the last-mentioned means is a clutch decoupling said mechanism from the means driving said mechanism and bringing said mechanism to standstill.

17. The apparatus defined in claim 15, further comprising means for jointly accelerating said spools subsequent to the operation of said clutch.

18. The apparatus defined in claim 7, further comprising speed-control means operatively connected to said mechanism for maintaining the speed thereof at a low level and responsive to said counter for thereafter accelerating said mechanism to a normal twisting speed.

* * * * *